US011806776B1

(12) United States Patent
Gargallo et al.

(10) Patent No.: US 11,806,776 B1
(45) Date of Patent: Nov. 7, 2023

(54) MOUTHPIECE FOR A SETTING DEVICE, A SETTING DEVICE WITH THE MOUTHPIECE AND A SETTING METHOD OF A BLIND RIVET ELEMENT USING THE MOUTHPIECE

(71) Applicant: Bollhoff Otalu S.A., La Ravoire (FR)

(72) Inventors: Jordi Gargallo, Bassens (FR); Bastien Billiemaz, Saint Baudille de la Tour (FR)

(73) Assignee: Bollhoff Otalu S.A., La Ravoire (FR)

( * ) Notice: Subject to any disclaimer, the term of this patent is extended or adjusted under 35 U.S.C. 154(b) by 0 days.

(21) Appl. No.: 18/209,086

(22) Filed: Jun. 13, 2023

(30) Foreign Application Priority Data

Jun. 24, 2022 (EP) ..... 22305913

(51) Int. Cl.
*B21J 15/28* (2006.01)

(52) U.S. Cl.
CPC ..... *B21J 15/28* (2013.01)

(58) Field of Classification Search
CPC . B21J 15/043; B21J 15/12; B21J 15/26; B21J 15/32; B21J 15/30; B21J 15/38; B21J 15/44; B21J 15/46; B25B 27/0007; F16B 19/10; F16B 19/1056; F16B 19/1045; F16B 19/1072; F16B 37/067; G01M 3/04; G01M 3/2884; Y10T 29/53752; Y10T 29/5377
See application file for complete search history.

(56) References Cited

U.S. PATENT DOCUMENTS 1,371,484 A * 3/1921 Howard ..... G01M 3/2884 269/21
3,982,421 A * 9/1976 Wallace ..... G01M 3/04 73/40
5,197,838 A * 3/1993 Schwab ..... B21J 15/043 411/34

(Continued)

FOREIGN PATENT DOCUMENTS

DE 102006031825 A1 1/2008
DE 202020101120 U1 3/2020
EP 3885589 A1 9/2021

OTHER PUBLICATIONS

EP Extended Search Report for EP Application No. 22305913.0 dated Jan. 17, 2023, (5 pages).

*Primary Examiner* — Tyrone V Hall, Jr.
(74) *Attorney, Agent, or Firm* — Reising Ethington P.C.

(57) ABSTRACT

A mouthpiece for a setting device setting a blind rivet element is disclosed which comprises a hollow, which may be a hollow-cylindrical, body having an abutting end and a central through bore through which a pulling mandrel of the setting device is movable. Further, a first endless sealing is arranged adjacent to the central through bore at the abutting end for abutting at a head portion of the blind rivet element. Additionally, a second endless sealing is arranged radially outwardly of the first endless sealing at the abutting end for abutting at a component. Finally, a fluid channel extends at least partly through the hollow, which may be a hollow-cylindrical, body such that an exit opening is provided between the first and the second endless sealing and an entry opening for supplying a testing fluid is provided, which may be remote to the abutting end.

14 Claims, 8 Drawing Sheets

(56) References Cited

U.S. PATENT DOCUMENTS

| | | | | |
|---|---|---|---|---|
| 2004/0060363 | A1* | 4/2004 | Smith | B21J 15/043 73/849 |
| 2015/0196951 | A1 | 7/2015 | Bigot et al. | |
| 2022/0381284 | A1 | 12/2022 | Rousseaux et al. | |

* cited by examiner

MOUTHPIECE FOR A SETTING DEVICE, A SETTING DEVICE WITH THE MOUTHPIECE AND A SETTING METHOD OF A BLIND RIVET ELEMENT USING THE MOUTHPIECE

CROSS REFERENCE TO RELATED APPLICATIONS

This application claims the priority to EP Patent Application No. EP22305913.0 filed on Jun. 24, 2022, and the entire content of this priority application is incorporated herein by reference in its entirety.

TECHNICAL FIELD

The present disclosure is related to a mouthpiece for a setting device setting a blind rivet element, a setting device for a blind rivet element and a setting method of a blind rivet element with a setting device having the mouthpiece.

BACKGROUND

Blind rivet nuts typically have a rivet shaft that has an internal thread and a rivet head. The rivet shaft is inserted into a component opening within which the blind rivet nut is to be set. Analogously, a blind rivet stud has a rivet shaft in combination with a stud including an outer thread. These blind rivet elements are known in the art.

After positioning the blind rivet element within the component opening, an axial tension is applied to the shaft of the blind rivet element which causes a compression of the rivet shaft and the setting of the same within the component opening. Thereafter, a pulling component is unscrewed from the blind rivet element.

For setting a blind rivet nut, a pulling mandrel is used as a pulling component. To this end, the pulling mandrel is screwed in the inner thread of the blind rivet nut.

For setting a blind rivet stud, a pulling nut is used as a pulling component. The pulling nut is exemplarily formed as a semi-hollow rod having an inner thread or as a hollow mandrel having an inner thread. For setting the blind rivet stud, the threaded stud is screwed in the inner thread of the pulling nut.

An example of such a blind rivet nut or insert is described in EP 3 885 589 A1. Here, the blind rivet insert comprises a bearing head forming an annular flange and a shank extending from an underside of the bearing head and comprising a head end, a foot end and a cylindrical bore extending in lengthwise direction from the head end to the foot end. Further, the shank has a first bore segment near the foot end, provided with an internal thread, and a second bore segment near the head end whose diameter is greater than the diameter of the first bore segment. The wall surrounding the second bore segment forms a deformable region of the shank. The underside of the bearing head comprises an annular underhead groove concentrically arranged to the shank and adapted for receiving a sealing ring in a mounted condition of the blind rivet insert. Further, only one annular retaining shank groove extends circumferentially around the shank, being arranged adjacent to the underside of the bearing head and retaining the sealing ring in a preloaded position before mounting the blind rivet insert.

When such blind rivet nuts or inserts with a sealing function due to the sealing ring are set into a component, presently all blind rivet inserts are first arranged in the respective component opening and are then set. Only thereafter the component is checked concerning the tightness or sealing function. In other words, only the entire component is checked with respect to the sealing function at the end of the production process. This course of procedure may be time consuming and leads either to the reworking of the component or the rejection of the complete component in case of leakage. This results in a lost of time and costs to identify the leakage location and bears the risk of installing a defective blind rivet nut and/or a defective component.

To this end, and with respect to respective control procedures on machine tools, it is referred to DE 10 2006 031 825 A1. Here, a machine for joining workpieces such as plates, nuts or bolts with plates and the like is described. The machine has a tool consisting of a stamp and a die or a down-holder which interacts with the stamp. Further, the machine comprises a test device operating with a gaseous or liquid control medium that can be fed to the point to be tested and a measuring device that detects a change in the state of the control medium. To this end, a control medium space is arranged in the test device to receive the control medium that acts on the end face of the plunger. Further, at least one control channel leads from this control medium space to the points of the tool that are at risk of breaking. Finally, and for checking the condition (pressure or flow) of the control medium, a sensor is arranged in the control medium space, in the control channel or in a space that leads to a measuring channel branching off from it and whose measured values can be routed to the measuring device to be checked.

The respective control method described in DE 10 2006 031 825 A1 is used on a machine equipped with a punch, die and/or down-holder as a tool, with the punch, die and/or down-holder being used to connect workpieces (plates, sheets, riveted parts, bolts) in the joining process. The tool control uses a liquid or gaseous control medium. To this end, a measuring device detecting a change in the state (pressure, flow, or consistency) of the control medium is present. The control medium is collected in a control medium space and can flow out of this control medium space in a targeted manner. The control medium is directed from the control medium space to the points of the tool to be checked. The state values of pressure, flow or consistency supplied to the measuring device are based on the values of the control medium in the control medium space.

A disadvantage of this course of procedure as well as the respective tool is that only the tool is checked. However, no evaluation of the finally produced connection with respect to the tightness or sealing function is performed.

It is therefore the problem of at least some implementations of the present disclosure to provide a mouthpiece for a setting device setting a blind rivet nut by means of which a sealing function can be checked before and/or after an individual blind rivet nut was set into the component opening. Further, it is also a problem of at least some implementations of the present disclosure to provide a respective setting device and a respective setting method.

SUMMARY

The above problem is solved by a mouthpiece for a setting device setting a blind rivet element as a blind rivet nut or a blind rivet stud, a setting device for a blind rivet element and a setting method of a blind rivet element with a setting device having the mouthpiece. Further embodiments and developments result from the following description, the drawings as well as the appending claims.

A mouthpiece for a setting device setting a blind rivet element, comprises a hollow, which may be a hollow-cylindrical, body having an abutting end and a central through bore through which a pulling component of the setting device is movable, a first endless sealing being arranged adjacent to the central through bore at the abutting end for abutting at a head portion of the blind rivet element, a second endless sealing being arranged radially outwardly of the first endless sealing at the abutting end for abutting at a component, and a fluid channel extending at least partly through the hollow, which may be a hollow-cylindrical, body such that an exit opening is provided between the first and the second endless sealing and an entry opening for supplying a testing fluid is provided, which may be remote, to the abutting end.

In the following, the mouthpiece will be described based on its usage in a setting device for setting blind rivet element. Besides the mouthpiece, such a setting device comprises an axially displaceable pulling component and a component drive to rotate the pulling component. The pulling component is made of a pulling mandrel having a work end including an outer thread to screw on a blind rivet nut and a drive end with which a releasable torque proof connection with the mandrel drive can be established.

For setting a blind rivet stud, the pulling component is made of a pulling nut having an inner thread to screw-in a blind rivet stud. The pulling nut further has a drive end by means of which a releasable torque proof connection with the mandrel drive can be established. Further, an axial pulling drive is provided in an operative connection with the pulling component with which an axial deformation displacement of the pulling component in the direction of the drive end is realizable deforming a blind rivet element. As blind rivet nut, it is for example assumed that the type as described in EP 3 885 589 A1 is used.

In a first step, the blind rivet element is arranged on the pulling component for example by screwing the blind rivet nut onto the work end of the pulling mandrel until a head portion of the blind rivet nut abuts at the first endless sealing. Alternatively, a blind rivet stud is screwed in the inner thread of the pulling nut until a head portion of the blind rivet stud abuts at the first endless sealing.

Next, the blind rivet element arranged on the pulling component is placed in a component opening with a predetermined force. The predetermined force may be at most 100 N, and may be less than 50 N. Such a force may be sufficient for initially evaluating the sealing function realized by a sealing ring of the blind rivet element by a blind rivet element having no sealing ring. Further, and in this stage, the second endless sealing abuts at the component. As a result of this arrangement, a closed chamber may be defined between the first endless sealing abutting at the head of the blind rivet element, the second endless sealing abutting at the component and the sealing ring of the blind rivet element.

Next, and for testing the sealing function of the sealing ring of the blind rivet element, the testing fluid is supplied to this space through the fluid channel having the exit opening between the first and the second endless sealing. As testing fluid, pressurized air may be used. This supply takes, for example, either place for a predetermined period of time or until a predetermined pressure value is reached. Then, the relative pressure is measured.

If the relative pressure is almost constant, the blind rivet element, i.e. the blind rivet nut or the blind rivet stud, is arranged in a sealing manner in the component opening and, thus, can be fastened therein by setting in a subsequent step. Accordingly, such a result would lead to the completion of the setting process. Consequently, the blind rivet element would be crimped in axial direction.

If, however, a loss in the relative pressure is detected, the blind rivet element is removed, and the process is repeated with a new blind rivet element.

An advantage of this course of proceeding is that each blind rivet element is tested with respect to the sealing function prior to setting. Accordingly, it is possible to identify a defective blind rivet element having, for example, no sealing ring before setting. As such a defective blind rivet element can be identified prior to setting, it is possible to remove it and to repeat the process with a new blind rivet element. Further, it is not necessary to test the complete component after manufacturing regarding the tightness thereof and the number of rejects can be reduced. Also, the respective method is time-efficient compared to the known methods.

A further advantage is that the configuration of the mouthpiece can be used with different already known setting devices. Accordingly, known setting devices can be retrofitted with the mouthpiece.

Additionally, and as the mouthpiece focuses on the design of the abutting end or abutting face, the remaining design thereof may fulfill other criteria.

In a further embodiment of the mouthpiece, the first endless sealing is arranged in a first portion at a first axial position and the second endless sealing is arranged in a second portion at a second axial position being different from the first axial position, wherein a transition portion or a step is present between the first and the second portion. With respect to this embodiment, the second portion may be arranged in a greater distance from the setting device compared to the first portion. This is because usually the head of the blind rivet element is arranged on the first component and thus, a respective projection is present. Consequently, the abutting end of the mouthpiece should be formed complementary to this arrangement.

In this regard, the first portion may have an inner diameter which may be larger than the diameter of the head of the blind rivet element. Thus, a gap is present into which the testing fluid can be supplied so that the tightness of the arrangement can be evaluated in a reliable manner.

Further, the first and/or the second portion may be formed annularly, and/or the exit opening of the fluid channel is present in the first portion. As the blind rivet element and the head thereof are usually formed round, the shape of the first and/or the second portion may be annularly. Due to this, the closed chamber into which testing fluid must be supplied can be limited in an effective manner. Consequently, the exit opening of the fluid channel may be present in the first portion, which may be in a position adjacent to the second portion so that it is not arranged on the head portion of the blind rivet element during use. This facilitates the supply of testing fluid.

Also, and according to a further embodiment of the mouthpiece, only one fluid channel is present. Due to the closed chamber which is formed between the first and the second endless sealing as well as the sealing ring of the blind rivet element and which is not interrupted by any blocking or further sealing, it may be useful to use only one fluid channel. This reduces the effort for producing the mouthpiece.

A setting device for a blind rivet element, comprises the following features: an axially displaceable pulling component and a component drive to rotate the pulling component, wherein the pulling component formed as a pulling mandrel has a work end including an outer thread to screw-on a blind rivet nut or the pulling component formed as a pulling nut has a work end including an inner thread to screw-in a blind rivet stud, and wherein the pulling component has a drive end with which a releasable torque-proof connection with the mandrel drive can be established, an axial pulling drive in an operative connection with the pulling component with which an axial deformation displacement of the pulling component in the direction of the drive end is realizable deforming the blind rivet element, and a mouthpiece according to one of the preceding embodiments.

In the setting device, the mouthpiece as discussed above is used. Thus, and for avoiding repetitions, it is referred to the above explanations regarding the technical effects and advantages.

In a first alternative embodiment of the setting device, the setting device may be a handheld device. According to a second alternative embodiment of the setting device, the setting device may be an automatic setting machine. With respect to handheld setting devices, safety measures are easily implemented. Thereby, employees are protected, and handling processes are improved. With respect to automatic setting machines, processing chains are made more efficient as the result of the test of the sealing function can be recorded and the next component opening can be provided automatically with a blind rivet nut or a blind rivet stud.

Further, the setting device comprises a control device for controlling a supply of testing fluid through the fluid channel in the mouthpiece, measuring the relative pressure and evaluating based on the measured relative pressure whether the blind rivet element is arranged in a sealing manner in the component opening. By means of this feature, the control unit is integrated into the setting device, which makes the overall system compact.

A setting method of a blind rivet element with a setting device having a mouthpiece, which may be a setting device, comprises the steps: screwing a blind rivet element on a work end of the pulling component until a head portion of the blind rivet element abuts at the first endless sealing, placing the blind rivet element in a component opening with a predetermined force, wherein the second endless sealing abuts at the component, supplying a testing fluid through the fluid channel and measuring the relative pressure, evaluating based on the measured relative pressure whether the blind rivet element is arranged in a sealing manner in the component opening, and if yes, setting the blind rivet element in the component opening by crimping the blind rivet element in axial direction, or if no, removing the blind rivet element and repeating the method with a new blind rivet element. Pressurized air may be used as testing fluid. By means of the method using the mouthpiece, on the above discussed technical effects and advantages can be achieved. Thus, and for avoiding redundancies, it is referred to the above explanations.

According to a further embodiment of the setting method, it may be evaluated based on the measured relative pressure in the repeated cycle whether the new blind rivet element is arranged in a sealing manner in the component opening, and if yes, the new blind rivet element is set in the component opening by crimping the new blind rivet nut in axial direction, or if no, it is indicated to check the component and/or the component is rejected. By means of these additional steps it is possible to identify a defective component or at least a component opening which is defective, for example due to a burr or an oversized hole. In case a respective indication for example due to a display is presented to the user, the user may check the component directly. Otherwise, the system may reject the component completely so that it may be checked later.

Further, the predetermined force may be 100 N at most. This pressure is relatively low so that a robot at which an automatic setting machine is arranged may apply the force. Consequently, the process can be further automated.

In an advantageous embodiment the testing fluid is supplied through the fluid channel for a predetermined supply period and/or until a predetermined pressure value is reached and, thereafter, the relative pressure is measured for a predetermined measuring period and/or after the predetermined measuring period has passed so that the evaluation is based on a comparison of the initially reached relative pressure value and the relative pressure value measured at the end of the predetermined measuring period and/or the course of the relative pressure measured during the predetermined measuring period. The evaluation of whether the sealing function is sufficient may be performed on alternative routes. On the one hand, the testing fluid is supplied through the fluid channel for a predetermined supply period. After this supply period, the relative pressure is measured and after a period of time has passed, the relative pressure is measured again. These two values can be compared and if the deviation is sufficiently small, i.e., within a predefined range, the sealing function is classified as okay. In an alternative, the relative pressure may be monitored over the complete period of time.

On the other hand, the testing fluid may be supplied until a predetermined relative pressure value has been reached. Thereafter, and after a period of time has passed, the relative pressure is measured again and both values are compared. Here, again, the relative pressure may be monitored over the complete testing time.

The above-mentioned method steps may be repeated after the blind rivet nut, or the new blind rivet element have been set into the component opening. This provides a double checking whether the setting process has led to a defective connection. If such a defective connection is identified after the setting process, the system may inform the user accordingly and directly indicate the defective connection. Thus, the user may attend to this defective connection so that time for searching and identifying the defective connection is saved.

Further, the steps of supplying a testing fluid through the fluid channel and measuring the relative pressure as well as evaluating based on the measured relative pressure whether the blind rivet element may be arranged in a sealing manner in the component opening are repeated after the blind rivet element or the new blind rivet element has been set in the component opening. To this end, it is additionally advantageous that if the blind rivet element or the new blind rivet element has been set in a sealing manner in the component opening, the connection is classified as okay or if the blind rivet element or the new blind rivet element has not been set in a sealing manner, the result is indicated. A result of the indication may be that the component is rejected or reworked. As discussed above and by means of this course, the user may directly attend to this defective connection so that time for searching and identifying the defective connection is saved.

BRIEF DESCRIPTION OF THE DRAWINGS

In the following, the present disclosure will be described in detail based on the drawings. In the drawings, the same reference signs denote the same elements and/or components. It shows.

DETAILED DESCRIPTION

Figure 1:
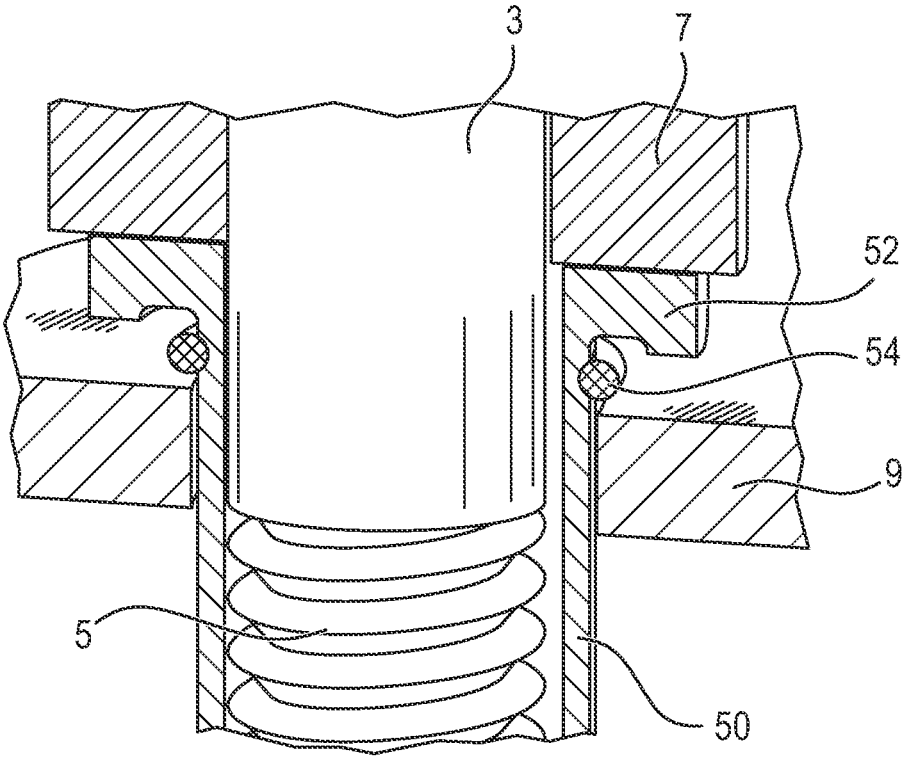
FIG. 1 a partial sectional view of a component opening with blind rivet nut inserted therein in a first position and a prior art mouthpiece abutting the blind rivet insert, FIG. 2 a partial sectional view of a component opening with blind rivet nut inserted therein in a second position and a prior art mouthpiece abutting the blind rivet insert, FIG. 3*a* a schematic cross-sectional view of a setting device with a first embodiment of a mouthpiece, FIG. 3*b* a schematic cross-sectional view of a setting device with a second embodiment of a mouthpiece, FIG. 4 a perspective view of a setting device with the mouthpiece according to FIG. 3, FIG. 5 a schematic view of a blind rivet nut with sealing ring and a setting device with the mouthpiece of FIG. 3 in a testing position, FIG. 6 an enlarged view of the arrangement of FIG. 5, FIG. 7 a schematic view of a blind rivet nut with sealing ring and a setting device with the mouthpiece of FIG. 3 in a setting position, FIG. 8 an enlarged view of the arrangement of FIG. 7, FIG. 9 a schematic view of a setting device with control device, and FIG. 10 a flow chart of an embodiment of the setting method.
Figure 2:
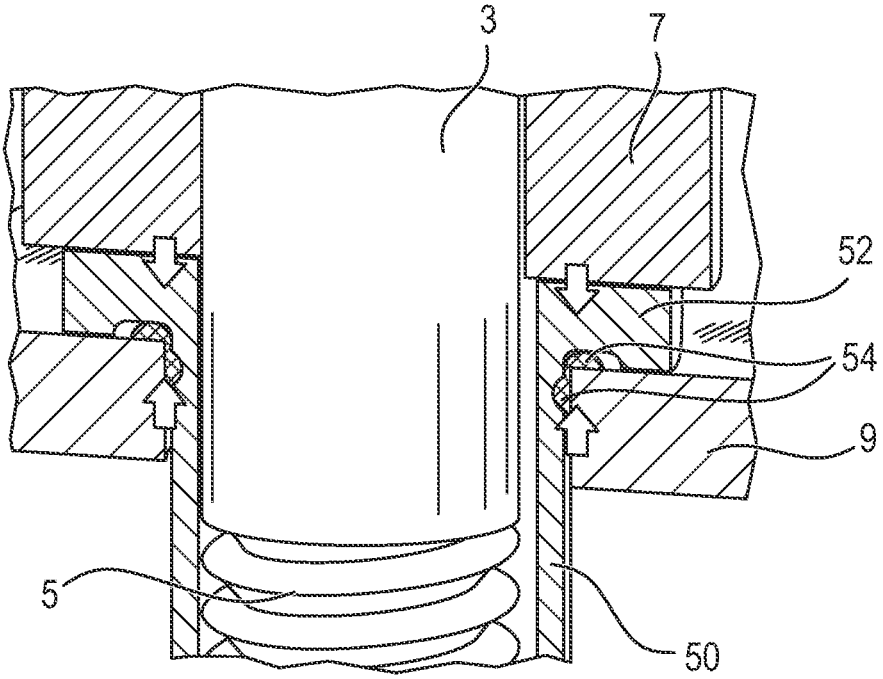

First, and with respect to FIGS. 1 and 2, the behavior of a blind rivet nut 50 having a head portion 52 and a sealing ring 54 during the setting process is discussed. A respective blind rivet nut 50 is for example described in EP 3 885 589 A1. In each case, an axially displaceable pulling mandrel 3 having an outer thread 5 is arranged in the blind rivet nut 50.

The setting behavior of the blind rivet nut 50 is similar to the analogous setting behavior of a blind rivet stud 50' during the setting process. The blind rivet stud 50' is exemplarily shown in FIG. 3*b* in combination with the mouthpiece 10.

The blind rivet stud 50' may have a stud 51. The stud 51 extends from rivet shaft which is deformed during the setting process. The rivet shaft has a head 52 including the same configuration as the head 52 of the blind rivet nut 50. Furthermore, the rivet shaft also has a sealing ring 54 arranged and dimensioned in the same manner as in the blind rivet nut 50. For deforming or crimping the blind rivet stud 50' during a setting process (see below), a pulling nut 3 is screwed on the outer thread of the stud 51. To this end, the pulling nut 3 has a matching inner thread. The pulling component 3' as a hollow mandrel having an inner thread may be provided.

In FIG. 1, the blind rivet nut 50 is arranged in the opening of the component 9 such that the sealing ring 54 is arranged adjacent to the component surface. An abutting end of a mouthpiece 7 of the setting device 1 abuts at the opposite surface of the head 52 of the blind rivet nut 50. To this end, the known mouthpiece 7 has a hollow-cylindrical body having the abutting end and a central through bore through which the pulling mandrel 3 of the setting device 1 is movable.

In FIG. 2, the blind rivet nut 50 has been arranged in the component opening such that the underside of the head portion 52 abuts at the component surface. Due to the force applied for pressing the blind rivet nut 50 into the component opening, the sealing ring 54 is pressed into the underhead groove of the blind rivet nut 50. Accordingly, and due to the sealing ring 54, a sealing function is provided by this blind rivet nut 50.

Whether each blind rivet nut 50 or each blind rivet stud 50' set into a component 9 fulfills its sealing function is presently checked after all blind rivet nuts 50 or each blind rivet stud 50' have been set into the component, i.e., at the end of the production process. This is disadvantageous as it leads to component rejects and involves a time-consuming process for identifying the defective connection.

Now referring to FIGS. 3 to 9, an embodiment of the mouthpiece 10 in combination with the respective setting device 1 is discussed.

The setting device 1 may be a handheld device or an automatic setting machine. With respect to handheld setting devices, safety measures are easily implemented. Thereby, employees are protected, and handling processes are improved. With respect to automatic setting machines, as shown in the embodiments according to FIGS. 3*a, b* to 9, processing chains are made more efficient as the result of the test of the sealing function can be recorded and the next component opening can be provided automatically with the blind rivet nut 50 or the blind rivet stud 50'.

Figure 3A:
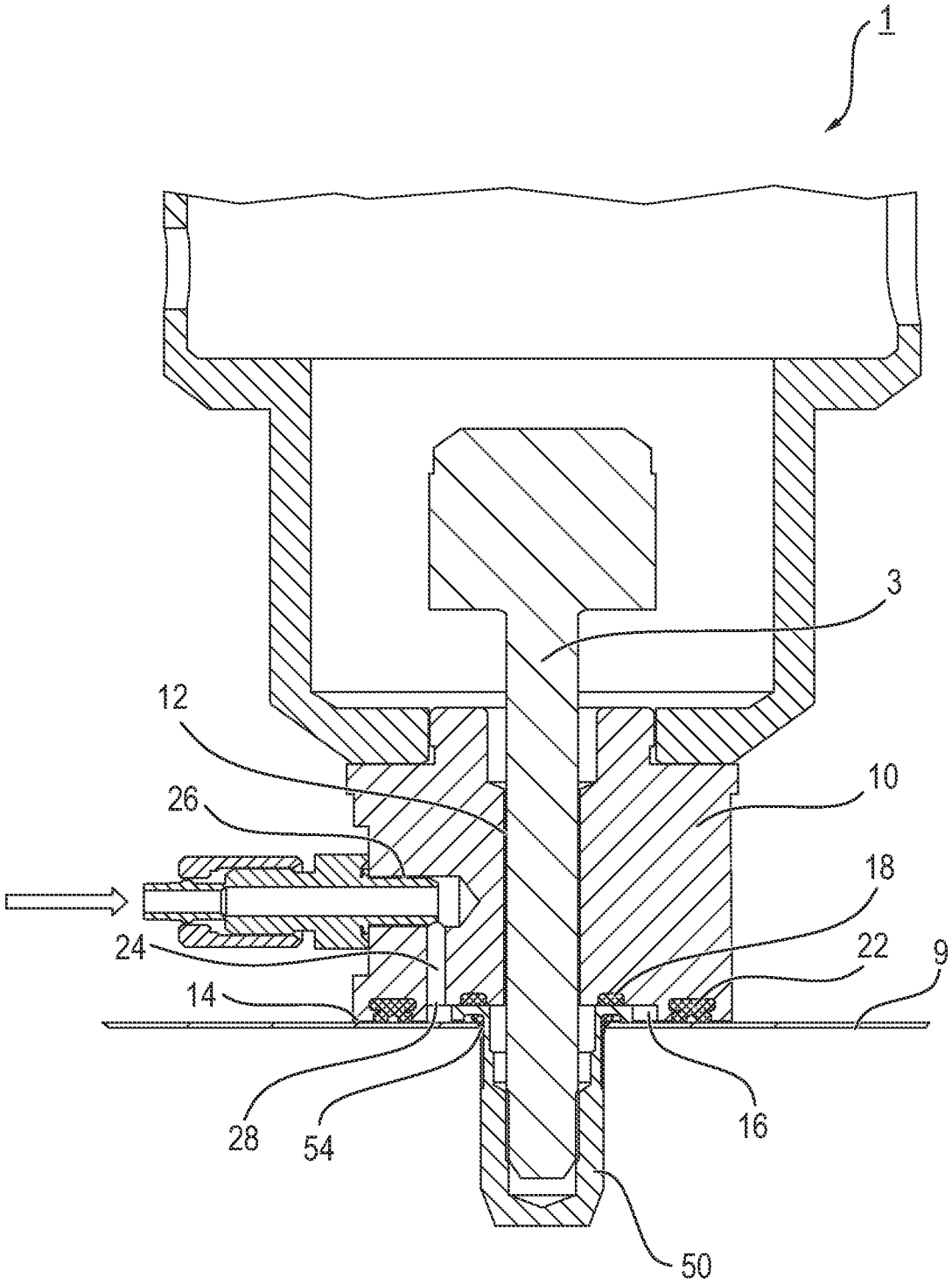

The setting device 1 according to the embodiment of FIG. 3*a* comprises the axially displaceable pulling mandrel 3 and a mandrel drive to rotate the pulling mandrel 3. The pulling mandrel 3 has a work end including the outer thread 5 to screw on the blind rivet nut 50 and a drive end with which a releasable torque proof connection with the mandrel drive can be established. Further, an axial pulling drive is provided in an operative connection with the pulling mandrel 3 with which an axial deformation displacement of the pulling mandrel 3 in the direction of the drive end is realizable deforming a blind rivet nut 50.

Figure 3B:
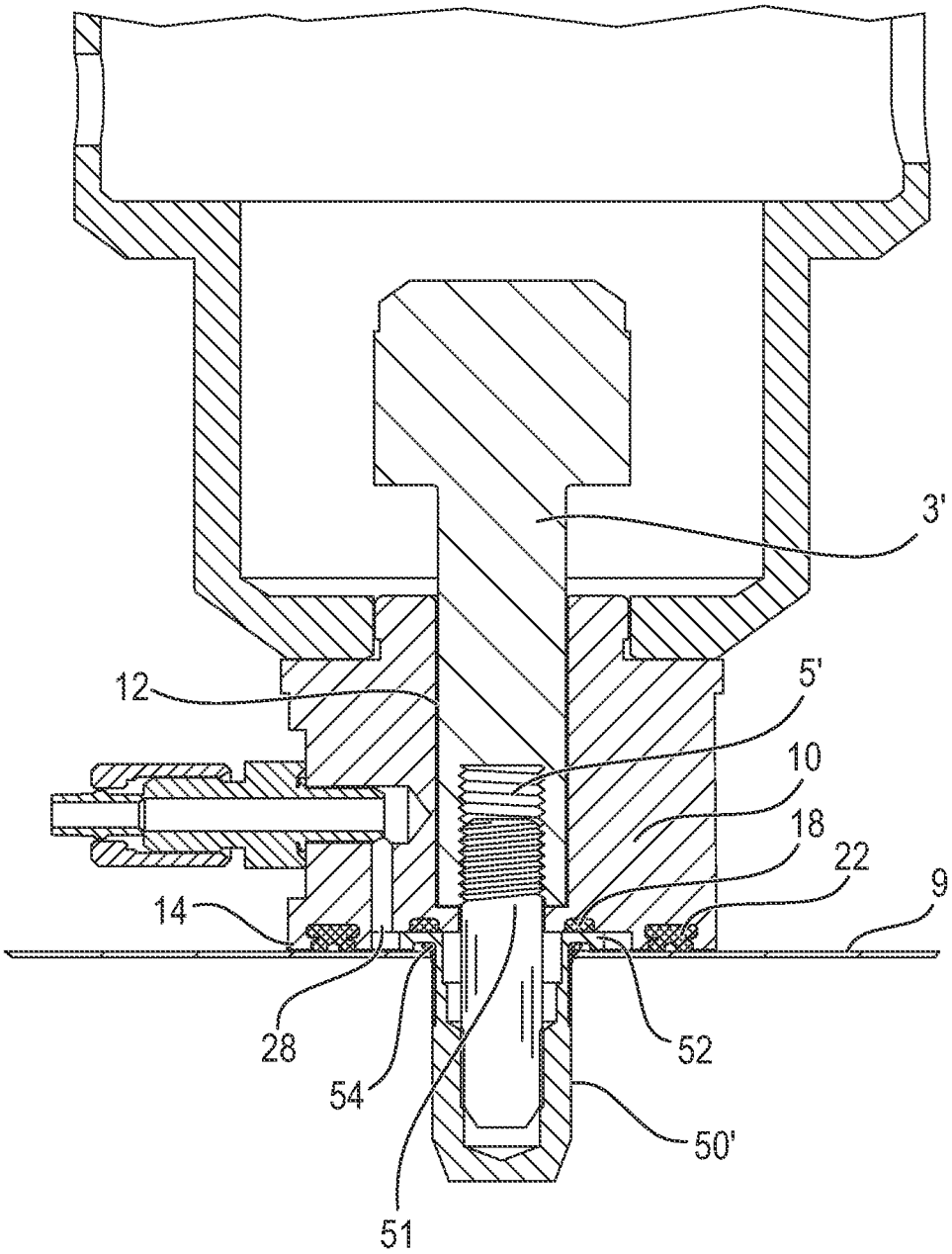
Figure 4:
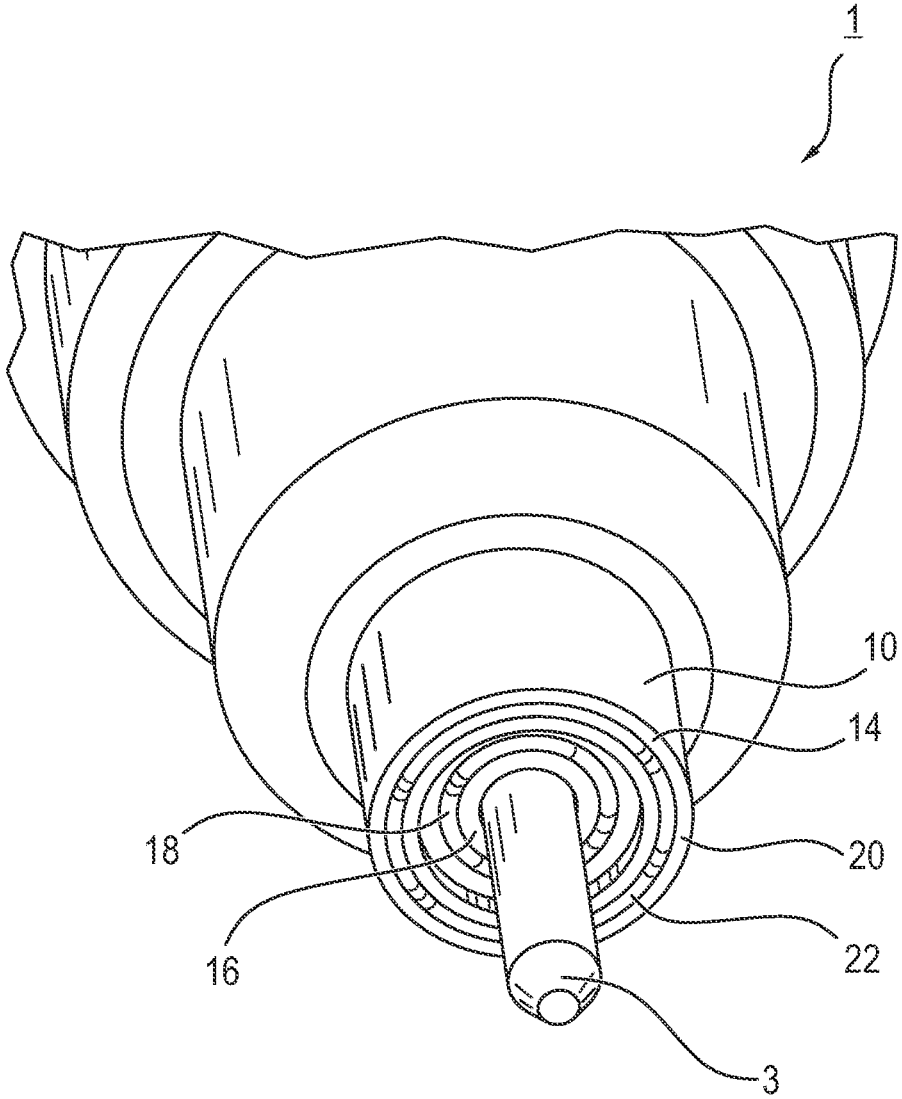

The setting device 1 for setting a blind rivet stud 50' is shown in FIG. 3*b*. It has a similar configuration and function as the setting device of FIG. 3*a*. The setting device of FIG. 3*b* is adapted for setting a blind rivet stud 50'. To this end, the pulling component is made of a pulling nut 3'. The pulling nut 3' has an inner thread to be screwed on the outer thread of the stud 51. The inner thread forms the work end of the pulling nut 3'. Besides the constructive differences described above, the pulling nut 3' has the same configuration and operates in the same way as the pulling mandrel 3. Accordingly, the details for the pulling mandrel 3 and the respective mouthpiece 7 and setting device 1 apply analogously to the setting device using the pulling nut 3' in combination with the mouthpiece 10.

The mouthpiece 10 according to an embodiment of the disclosure has the hollow-cylindrical body having the abutting end 14 and a central through bore 12 through which the pulling mandrel 3 of the setting device 1 is movable. In contrast to the prior art mouthpieces, mouthpiece 10 has a first portion 16 with a first endless sealing 18 and a second portion 20 with a second endless sealing 22. One or both of the first 16 and the second portion 20 may be formed annularly. To this end, the first endless sealing 18 is arranged adjacent to the central through bore 12 at the abutting end 14 for abutting at a head portion 52 of the blind rivet nut 50. The second endless sealing 22 is arranged radially outwardly of the first endless sealing 18 at the abutting end 14 for abutting at the component 9.

Further, the first portion 16 is arranged at a first axial position and the second portion 20 is arranged at a second axial position being different from the first axial position. Due to this arrangement, and as usually the head portion 52 of the blind rivet nut 50 projects from the surface of the component 9, the abutting end 14 is formed matching to this configuration so that a closed chamber can be formed, as explained below. The second portion 20 may be arranged further in the direction of the component 9 so that it surrounds the blind rivet nut 50 when the blind rivet nut 50 is arranged in an abutting manner in the first portion 16.

Between the first 16 and the second portion 20, a transition portion or a step is present. In the embodiment shown, a step is present between both portions 16, 20, Nevertheless, an inclined transition portion may be used instead or in addition, depending on the field of application.

Further, the mouthpiece 10 comprises a fluid channel 24 extending at least partly through the hollow-cylindrical body. An entry opening 26 for supplying a testing fluid, which may be pressurized air, is provided remote to the abutting end 14. An exit opening 28 of the fluid channel 24 is provided between the first 18 and the second endless sealing 22, which may be in the first portion 16. Further, and as shown in the figures, only one fluid channel 24 is present.

An advantage of this mouthpiece 10 is that the configuration of the mouthpiece 10 can be used with different already known setting devices. Accordingly, known setting devices can be retrofitted with the mouthpiece 10.

Additionally, and as the mouthpiece 10 focuses on the design of the abutting end 14 or abutting face, the remaining design thereof may fulfill other criteria.

Figure 5:
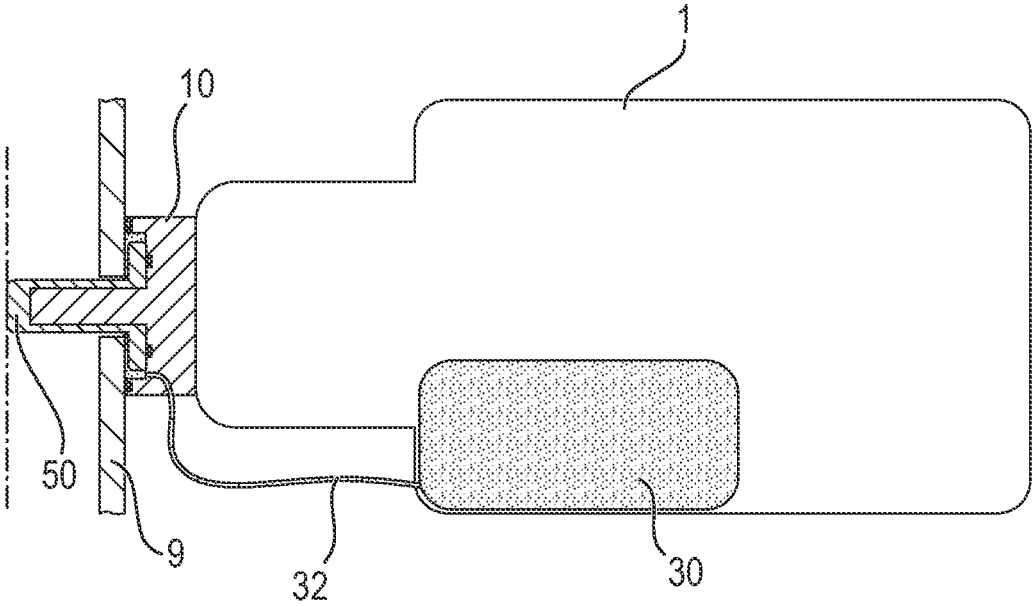
Figure 6:
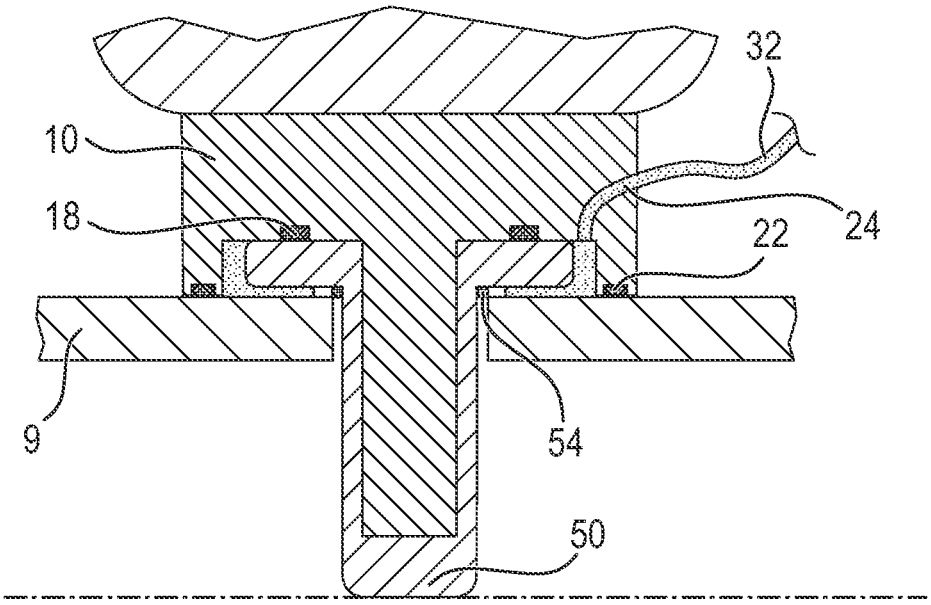
Figure 7:
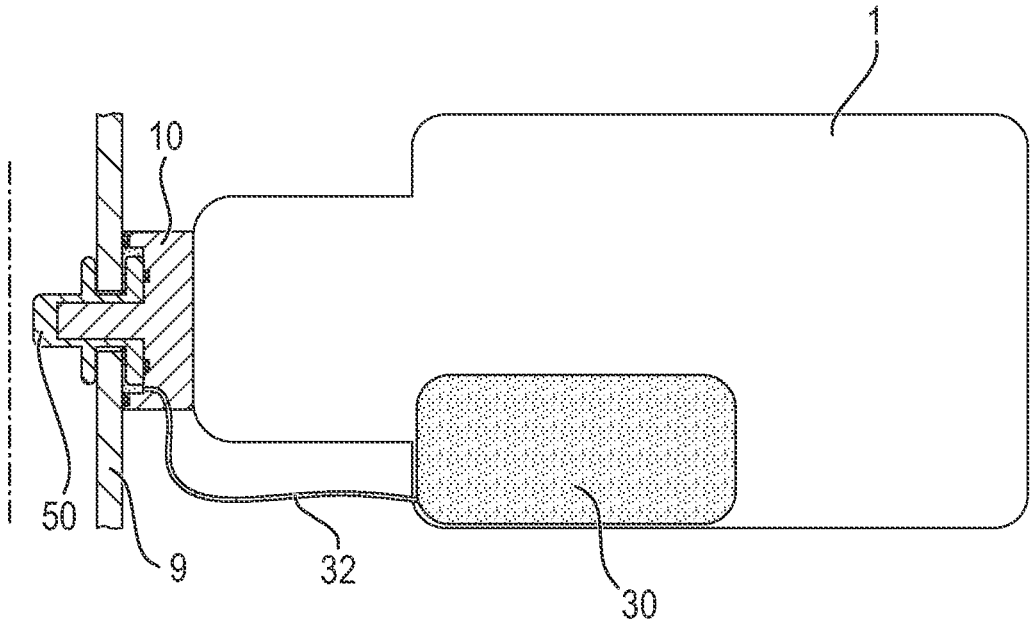
Figure 8:
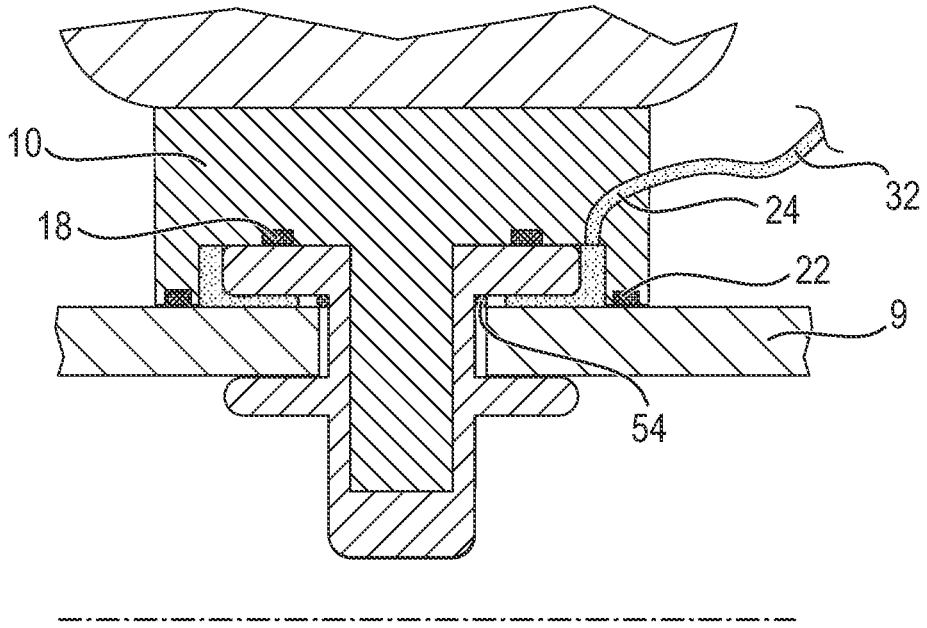
Figure 9:
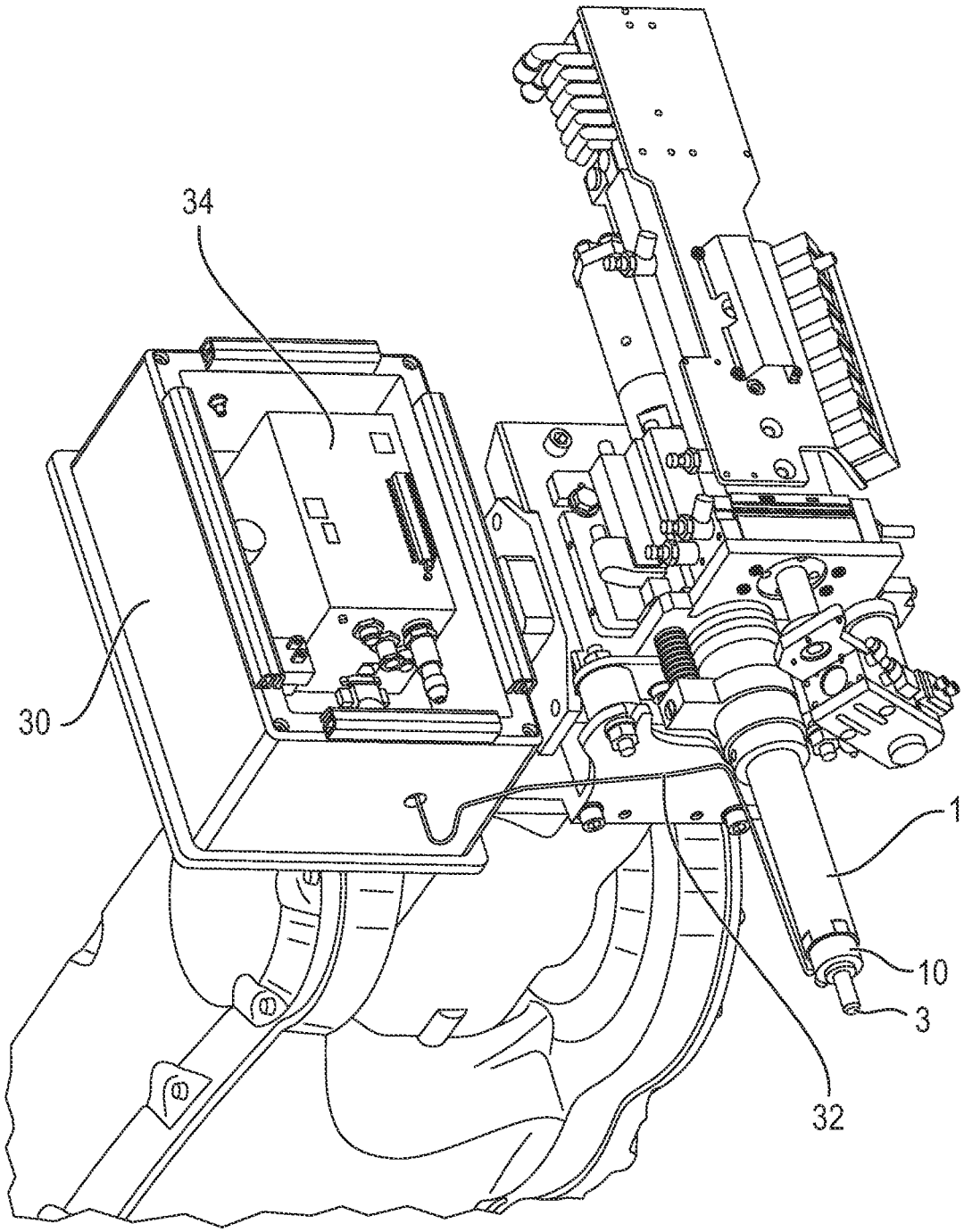

To this end, the setting device may comprise a control device 30 for evaluating whether the blind rivet nut 50 is arranged in a sealing manner in the component opening. In this regard, FIGS. 5, 7 and 9 show a control device 30. The control device 30 is configured and used for controlling a supply of the testing fluid through the fluid channel 24 in the mouthpiece 10. For this reason, a testing fluid line 32 connects the entry opening 26 of the fluid channel 24 with the control device 30, which may be with a control unit 34. Further, and by means of the control device 30, which may be the control unit 34, the relative pressure is measured. Analogously, the control device 30, and the control unit 34, can evaluate based on the measured relative pressure whether the blind rivet nut 50 may be arranged in a sealing manner in the component opening.

Figure 10:
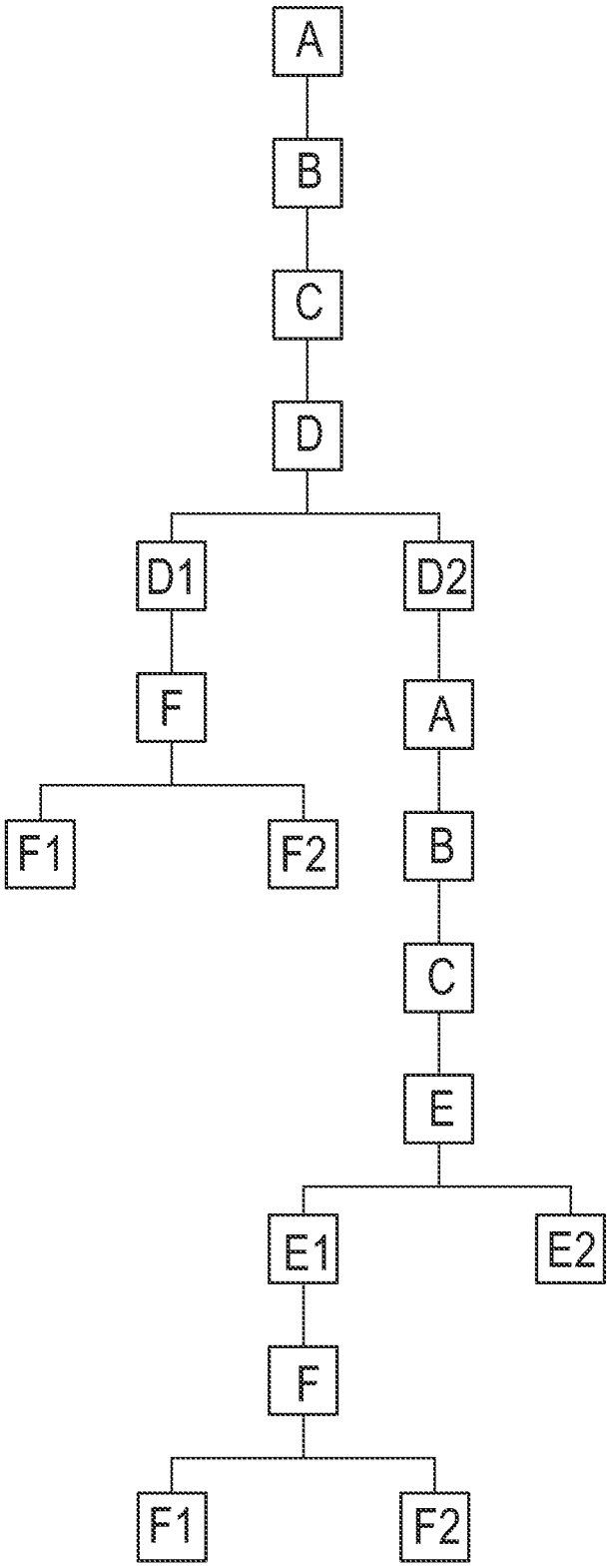

Now further referring to FIG. 10 showing a flow chart of an embodiment of a setting method, the process using the mouthpiece 10 is explained in detail. The setting process of the blind rivet nut 50 may be similar to the setting process of the blind rivet stud 50'. Thus, the setting method applies to the setting process of the blind rivet stud 50' as well.

In a first step A, the blind rivet nut 50 is screwed on the work end of the pulling mandrel 3 until a head portion 52 of the blind rivet nut 50 abuts at the first endless sealing 18. Next, and in step B, the blind rivet nut 50 which is arranged on the pulling mandrel 3 is placed in a component opening with a predetermined force. As discussed above, the predetermined force may be at most 100 N. Such a force is sufficient for initially evaluating the sealing function realized by the sealing ring of the blind rivet nut. Further, such a force can be applied by a robot, which is for example used in combination with the setting device 1, as shown in FIG. 9. At the end of this step, the second endless sealing 22 abuts at the component 9 and a closed chamber is defined between the first endless sealing 18 abutting at the head portion 52 of the blind rivet nut 50, the second endless sealing 22 abutting at the component 9 and the sealing ring 54 of the blind rivet nut 50.

Next, and for testing the sealing function of the sealing ring 54 of the blind rivet nut 50, the testing fluid is supplied to this closed chamber through the fluid channel 24 having the exit opening 28 between the first 18 and the second endless sealing 22. As testing fluid, pressurized air may be used. This supply takes, for example, either place for a predetermined period of time or until a predetermined pressure value is reached. Then, the relative pressure is measured.

Subsequently, based on the measured relative pressure, it is evaluated in step D whether the blind rivet nut 50 is arranged in a sealing manner in the component opening.

The testing fluid may be supplied through the fluid channel 24 for a predetermined supply period and/or until a predetermined pressure value is reached and, thereafter, the relative pressure is measured for a predetermined measuring period and/or after the predetermined measuring period has passed so that the evaluation is based on a comparison of the initially reached relative pressure value and the relative pressure value measured at the end of the predetermined measuring period and/or the course of the relative pressure measured during the predetermined measuring period.

The evaluation of whether the sealing function is sufficient may be performed on alternative routes. On the one hand, the testing fluid is supplied through the fluid channel for a predetermined supply period. After this supply period, the relative pressure is measured and after a period of time has passed, the relative pressure is measured again. These two values can be compared and if the deviation is sufficiently small, i.e., within a predefined range, the sealing function is classified as okay. In an alternative, the relative pressure may be monitored over the complete period of time.

On the other hand, the testing fluid may be supplied until a predetermined relative pressure value has been reached. Thereafter, and after a period of time has passed, the relative pressure is measured again and both values are compared. Here, again, the relative pressure may be monitored over the complete testing time.

Thus, and for example, if the relative pressure is almost constant, it is assumed that the blind rivet nut 50 is arranged in a sealing manner in the component opening. Consequently, the blind rivet nut 50 can be fastened therein by setting in a subsequent step D1. Accordingly, such a result would lead to the completion of the setting process. Consequently, the blind rivet nut 50 will be crimped in axial direction (cf. FIGS. 7 and 8) and the process for this connection location is completed. Accordingly, the user or the robot at which the setting device 1 is fastened may move to the next connection location at the same component and the process or method is started again at the new location.

If, however, a loss in the relative pressure is detected and it is, thus, evaluated that the blind rivet nut 50 is not arranged in a sealing manner in the component opening, the blind rivet nut 50 is removed in step D2. Thereafter, the process is repeated with a new blind rivet nut 50.

An advantage of this course of proceeding is that each blind rivet nut 50 is tested with respect to the sealing function prior to setting. Accordingly, it is possible to identify a defective blind rivet nut 50 having, for example, no sealing ring 54 before setting. As such a defective blind rivet nut 50 can be identified prior to setting, it is possible to remove it and to repeat the process with a new blind rivet nut 50. Further, it is not necessary to test the complete component 9 after manufacturing regarding the tightness thereof and the number of rejects can be reduced. Also, the respective method is time-efficient compared to the known methods.

Assuming that the sealing function of the blind rivet nut 50 has been classified as okay prior to setting, the above-mentioned step of supplying a testing fluid through the fluid channel and measuring the relative pressure as well as evaluating based on the measured relative pressure whether the blind rivet nut 50 is arranged in a sealing manner in the component opening are repeated in step F after the blind rivet nut 50 has been set in the component opening. This provides a double checking whether the setting process has led to a defective connection.

If the blind rivet nut 50 or the new blind rivet nut 50 has been set in a sealing manner in the component opening, and thus, not lost the sealing function, the connection is classified as okay in step F1.

If, on the other hand, a defective connection is identified after the setting process, this result is indicated in step F2. Thus, and as the defective connection can be indicated, the user may attend to this defective connection so that time for searching and identifying the defective connection is saved. Accordingly, a result of the indication may be that the component is reworked. Alternatively, the component may be rejected.

In case the process must be repeated with a new blind rivet nut 50, it is evaluated in step E based on the measured relative pressure in the repeated cycle whether the new blind rivet nut 50 is arranged in a sealing manner in the component opening. Like for the above blind rivet nut 50, it applies also for the new blind rivet nut 50 that if the evaluation leads to the result that the blind rivet nut 50 is arranged in a sealing manner in the component opening, the new blind rivet nut 50 is set in the component opening in step E1 by crimping the new blind rivet nut 50 in axial direction.

In case the result indicates that also the new blind rivet nut 50 is not arranged in a sealing manner in the component opening, it is indicated in step E2, which may be to the user, to check the component 9. Alternatively, or additionally, the component 9 is rejected in step E2. By means of these additional steps it is possible to identify a defective component or at least a component opening which is defective, for example due to a burr or an oversized hole. In case a respective indication for example due to a display is presented to the user, the user may check the component directly. Otherwise, the component may be rejected completely so that it may be checked later.

Again assuming that the sealing function of the new blind rivet nut 50 has been classified as okay prior to setting, the above-mentioned step of supplying a testing fluid through the fluid channel 24 and measuring the relative pressure as well as evaluating based on the measured relative pressure whether the blind rivet nut 50 is arranged in a sealing manner in the component opening are repeated in step F after the blind rivet nut 50 has been set in the component opening. This provides a double checking whether the setting process has led to a defective connection.

If the new blind rivet nut 50 has been set in a sealing manner in the component opening, and thus, not lost the sealing function, the connection is classified as okay in step F1.

If, on the other hand, a defective connection is identified after the setting process, this result is indicated in step F2. Thus, and as the defective connection can be indicated, the user may attend to this defective connection so that time for searching and identifying the defective connection is saved. Consequently, a result of the indication may be that the component is reworked. Alternatively, the component may be rejected.

The invention claimed is:

1. A mouthpiece for a setting device setting a blind rivet element, comprising:

a. a hollow body having an abutting end and a central through bore through which a pulling component of the setting device is movable, b. a first endless sealing being arranged adjacent to the central through bore at the abutting end for abutting at a head portion of the blind rivet element, c. a second endless sealing being arranged radially outwardly of the first endless sealing at the abutting end for abutting at a component, and d. a fluid channel extending at least partly through the hollow body such that an exit opening is provided between the first and the second endless sealing and an entry opening for supplying a testing fluid is provided remote to the abutting end.

2. The mouthpiece according to claim 1, wherein the first endless sealing is arranged in a first portion at a first axial position and the second endless sealing is arranged in a second portion at a second axial position being different from the first axial position, wherein a transition portion or a step is present between the first and the second portion.

3. The mouthpiece according to claim 2, wherein the first and/or the second portion are formed annularly, and/or the exit opening of the fluid channel is present in the first portion.

4. The mouthpiece according to claim 1, wherein only one fluid channel is present.

5. A setting device for a blind rivet element, comprising the following features:

a. an axially displaceable pulling component and a component drive to rotate the pulling component, wherein the pulling component formed as a pulling mandrel has a work end including an outer thread to screw-on a blind rivet nut or the pulling component formed as a pulling nut has a work end including an inner thread to screw-in a blind rivet stud, and wherein the pulling component has a drive end with which a releasable torque-proof connection with the mandrel drive can be established, b. an axial pulling drive in an operative connection with the pulling component with which an axial deformation displacement of the pulling component in the direction of the drive end is realizable deforming the blind rivet element, and c. a mouthpiece according to claim 1.

6. The setting device according to claim 5, wherein the setting device is a handheld device.

7. The setting device according to claim 5, wherein the setting device is an automatic setting machine.

8. The setting device according to claim 5, further comprising a control device for a. controlling a supply of testing fluid through the fluid channel in the mouthpiece, b. measuring the relative pressure and c. evaluating based on the measured relative pressure whether the blind rivet element is arranged in a sealing manner in the component opening.

9. A setting method of a blind rivet element with a setting device having a mouthpiece according to claim 1, comprising the steps:

a. screwing a blind rivet element in a work end of a pulling component until a head portion of the blind rivet element abuts at the first endless sealing, b. placing the blind rivet element in a component opening with a predetermined force, wherein the second endless sealing abuts at the component, c. supplying a testing fluid through the fluid channel and measuring the relative pressure, d. evaluating based on the measured relative pressure whether the blind rivet element is arranged in a sealing manner in the component opening, and d1. if yes, setting the blind rivet element in the component opening by crimping the blind rivet element in axial direction, or d2. if no, removing the blind rivet element and repeating the method with a new blind rivet element.

10. The setting method according to claim 9, wherein based on the measured relative pressure in the repeated cycle it is evaluated whether the new blind rivet element is arranged in a sealing manner in the component opening, and e1. if yes, setting the new blind rivet element in the component opening by crimping the new blind rivet nut in axial direction, or e2. if no, indicating to check the component and/or rejecting the component.

11. The setting method according to claim 9, wherein the testing fluid is supplied through the fluid channel for a predetermined supply period and/or until a predetermined pressure value is reached and, thereafter, the relative pressure is measured for a predetermined measuring period and/or after the predetermined measuring period has passed so that the evaluation is based on a1. a comparison of the initially reached relative pressure value and the relative pressure value measured at the end of the predetermined measuring period and/or a2. the course of the relative pressure measured during the predetermined measuring period.

12. The setting method according to claim 9, wherein the steps of supplying a testing fluid through the fluid channel and measuring the relative pressure as well as evaluating based on the measured relative pressure whether the blind rivet element is arranged in a sealing manner in the component opening are repeated after the blind rivet element or the new blind rivet element has been set in the component opening.

13. The setting method according to claim 12, wherein a. if the blind rivet element or the new blind rivet element has been set in a sealing manner in the component opening, the connection is classified as okay, or b. if the blind rivet element or the new blind rivet element has not been set in a sealing manner, the result is indicated.

14. The setting method according to claim 9, wherein pressurized air is used as testing fluid.

* * * * *